United States Patent [19]

Cooper et al.

[11] Patent Number: 4,476,459

[45] Date of Patent: Oct. 9, 1984

[54] THEFT DETECTION METHOD AND APPARATUS IN WHICH THE DECAY OF A RESONANT CIRCUIT IS DETECTED

[75] Inventors: Michael N. Cooper, Flushing; Peter A. Pokalsky, East Meadow, both of N.Y.

[73] Assignee: Knogo Corporation, Hicksville, N.Y.

[21] Appl. No.: 314,440

[22] Filed: Oct. 23, 1981

[51] Int. Cl.[3] ..... G08B 13/24

[52] U.S. Cl. ..... 340/572; 343/6.8 LC

[58] Field of Search ..... 340/572; 343/6.8 LC, 343/6.8 R

[56] References Cited

U.S. PATENT DOCUMENTS

| | | | |
|---|---|---|---|
| 2,812,427 | 11/1957 | Magondeaux | 250/6 |
| 2,899,546 | 8/1959 | Hollmann | 250/6 |
| 2,958,781 | 11/1960 | Marchal et al. | 250/83.3 |
| 3,117,277 | 1/1964 | de Magondeaux | 325/6 |
| 3,373,425 | 3/1968 | Barischoff | 343/6.8 |
| 3,740,742 | 6/1973 | Thompson et al. | 340/572 |
| 3,810,172 | 5/1974 | Burpee et al. | 340/572 |
| 3,836,842 | 9/1974 | Zimmermann et al. | 340/572 |
| 3,911,534 | 10/1975 | Martens et al. | 340/572 |
| 3,919,704 | 11/1975 | Williams et al. | 340/572 |
| 4,135,184 | 1/1979 | Pruzick | 340/572 |
| 4,215,342 | 7/1980 | Horowitz | 340/572 |
| 4,242,671 | 12/1980 | Plows | 340/572 |
| 4,321,586 | 3/1982 | Cooper et al. | 340/572 |

FOREIGN PATENT DOCUMENTS 2033401 12/1970 France .

*Primary Examiner*—Glen R. Swann, III

*Attorney, Agent, or Firm*—Fitzpatrick, Cella, Harper & Scinto

[57] ABSTRACT

In an electronic theft detection apparatus the passage of a resonant circuit wafer 16 through an interrogation zone formed by transmitter and receiving antennas (30, 90) (32, 92) is detected by generating sharp pulses of electromagnetic energy to cause the resonant circuit wafer to resonate for a duration following each pulse. A receiver is provided with a switch (54), signal accumulators or filters (56 and 58) and a comparator (60) to sense the decay of the signal from the resonating wafer and to activate an alarm (36) when that decay occurs at a predetermined value.

31 Claims, 8 Drawing Figures

THEFT DETECTION METHOD AND APPARATUS IN WHICH THE DECAY OF A RESONANT CIRCUIT IS DETECTED

BACKGROUND OF THE INVENTION

1. Field of the Invention

This invention relates to article theft detection and more particularly it concerns novel apparatus and methods for electronically detecting the passage of protected articles through a interrogation zone such as a "wrap desk" counter or the exit from a store or other protected area.

2. Description of the Prior Art

The present invention constitutes improvements over the stolen merchandise detection method and apparatus described in U.S. Pat. No. 3,740,742 to Thomas F. Thompson and Joseph W. Griffith. That patent describes apparatus for detecting the passage of a resonant electronic circuit through an aisle in a store through which customers must pass. Plates or coils are provided along the aisle and then are energized with pulses to produce sharp electrostatic or electromagnetic pulses in the aisle. These pulses cause resonant electrical circuits, attached to the protected articles carried through the aisle, to resonate for a duration following each pulse. A receiver is provided to detect the resultant radiation from the resonant circuits and the receiver is gated to detect signals only after the energizing pulse has terminated.

Other apparatus which detect resonant electrical circuits by generating pulses and monitor the resulting radiation from the resonanting circuits are shown and described in U.S. Pat. Nos. 2,812,427, 2,899,546, 2,958,781, 3,117,277 and 3,373,425. These patents, however, are concerned principally with long distance signal transmission and they have nothing to do with detection of stolen articles.

A disadvantage of the above described theft detection method and apparatus, and of the devices of the other patents referred to above, if they were applied to theft detection, is that they are, or would be, susceptible to false alarms caused by radiation from other sources in the vicinity of the apparatus. The signal emanating from the resonant circuit is of extremely low amplitude and it is easily overpowered by radiation from nearby electrical equipment such as lights, motors or switches or even from nearby theft detection equipment; and in some cases from ringing or transients within the detection equipment itself. It has been proposed to reduce the interference of other radiation sources by making the monitoring apparatus sensitive only to the specific resonant frequency of the circuits on the protected articles. However, it is difficult in practice to make those circuits each resonate at precisely the same frequency. Moreover, the circuits are sometimes subject to detuning, as when they are placed next to a piece of metal or next to another resonant circuit. Also, this does not protect against transient responses or continuous electrical noise from various sources other than the resonant circuits being detected and which produce signals at the resonant frequency of the resonant circuit being detected.

SUMMARY OF THE INVENTION

The present invention overcomes the above described disadvantages of the prior art and it makes possible an electronic theft detection method and apparatus of the type in which a resonant electrical circuit carried on protected goods is detected using an interrogating pulse followed by a detection of the resulting signal radiated from or generated by the resonant circuit and in which the detection is not adversely affected by the presence of radiated energy from other sources or from nearby monitoring equipment.

According to the present invention, interrogation signals are produced in the form of short pulses of electromagnetic field energy in the interrogation zone. These pulses are separated by intervals. During each interval the electromagnetic energy in the interrogation zone is detected; and, in response to a predetermined amount of variation of electromagnetic energy detected in the intervals, an alarm is activated. The invention makes use of the fact that a resonant electrical circuit continues to resonate at a predetermined rate of decay after receiving an energizing pulse. This distinguishes the resonant circuit from transients in the pulse generating system and in the detector itself which decay and subside almost immediately after the energizing pulse, as well as from metal objects in the area which may also resonate, but only for a very brief period. It also distinguishes the resonant circuit from continuous electrical noise which may include the resonant frequency of the resonant circuit but which continues at a relatively constant amplitude without decay. Also, by basing the detection on the rate of decay of the signals being detected, it is possible to use a detection arrangement which is not precisely tuned to a specific frequency. This reduces the precision with which the target resonant circuits have to be tuned. It also permits the detection apparatus to have a wide frequency response.

The invention is applicable to a so-called "wrap desk" where a detection device is provided to detect the presence of a resonant circuit wafer on an article being wrapped for a customer and thereby remind a salesperson at the desk that the wafer should be removed. Such wrap desk detection devices have been built and operated successfully. The invention is also applicable to an exit detection system where an antenna is positioned at a doorway or other exit from a protected area to detect the passage of protected articles from the protected area. The exit detection device has not yet been built; but it is proposed in connection with the invention.

In a more specific aspect, the invention makes use of the signals detected in the intervals following several interrogation pulses. This is done by dividing the intervals between each pulses into different time segments and by directing the signals detected in corresponding time segments into corresponding signal accumulators, such as low pass filters. The signal levels in the different signal accumulators are continuously compared; and when the difference in the accumulated signal level in the accumulators reaches a predetermined amount, an alarm is actuated.

BRIEF DESCRIPTION OF THE DRAWINGS

Preferred embodiments of the invention have been chosen for purposes of description and illustration and are shown in the accompanying drawings in which.

Figure 6A:
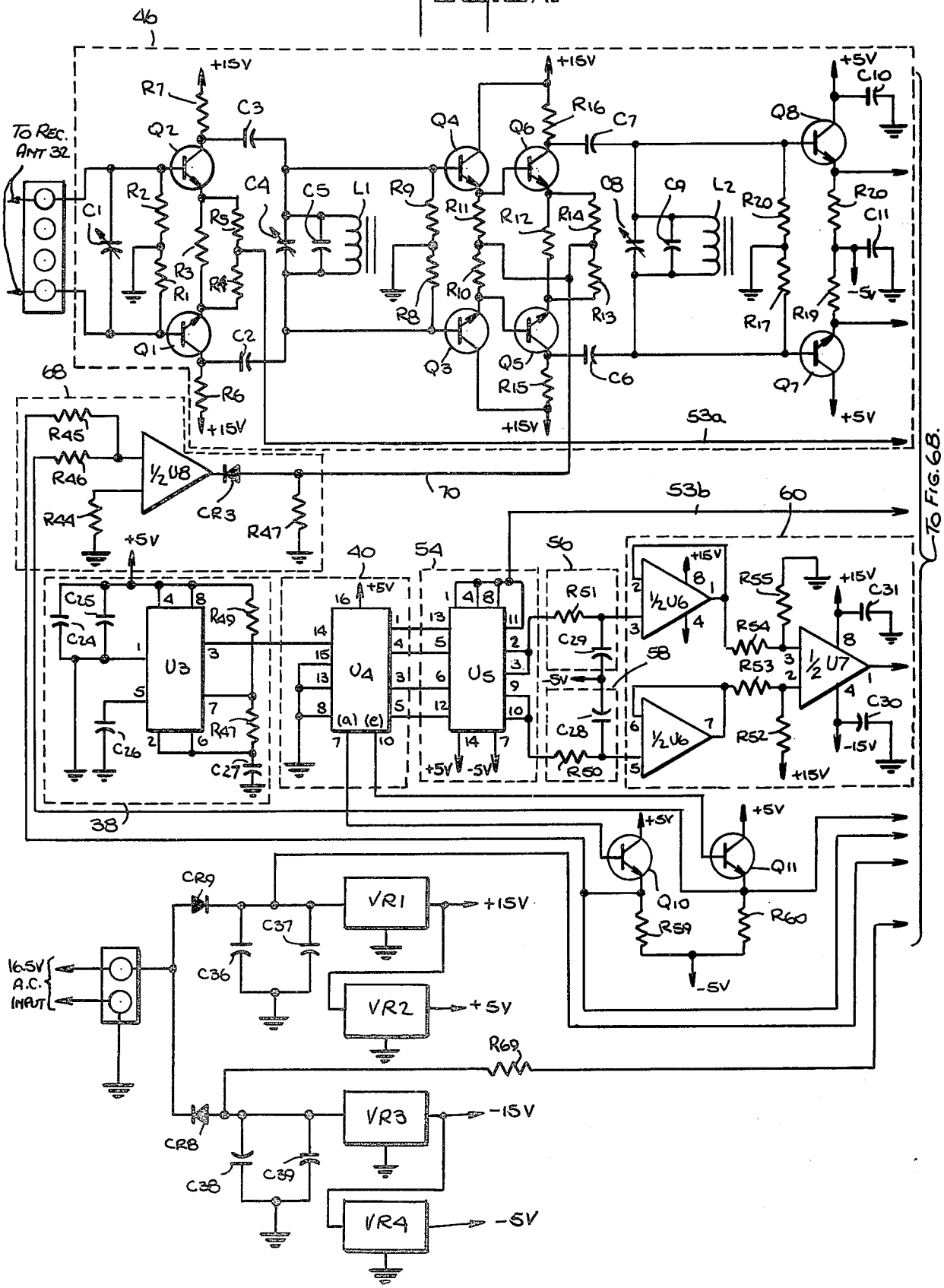
FIGS. 6A and 6B are a detailed circuit diagram of the embodiment of FIG. 1.
Figure 6B:
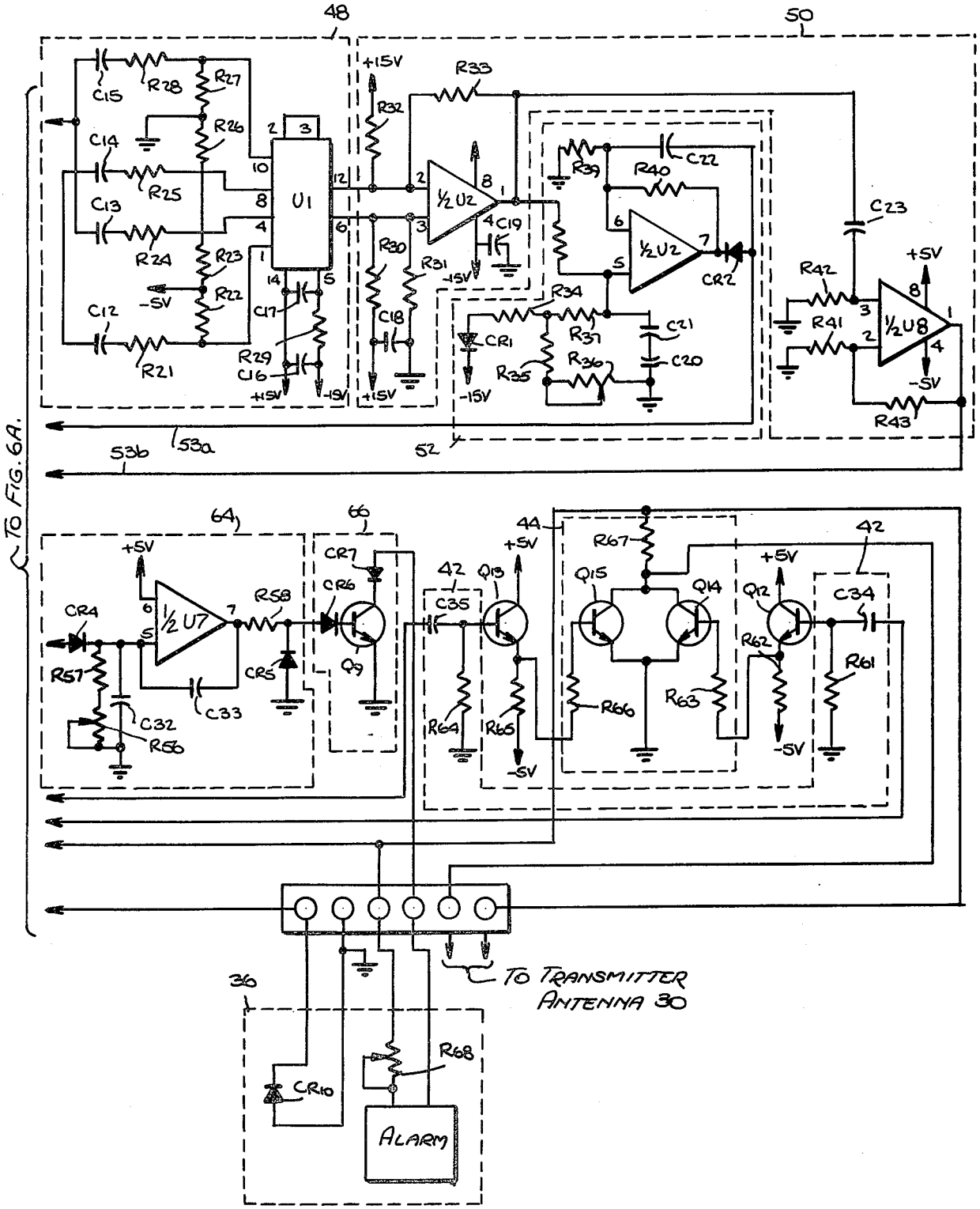
Figure 7:
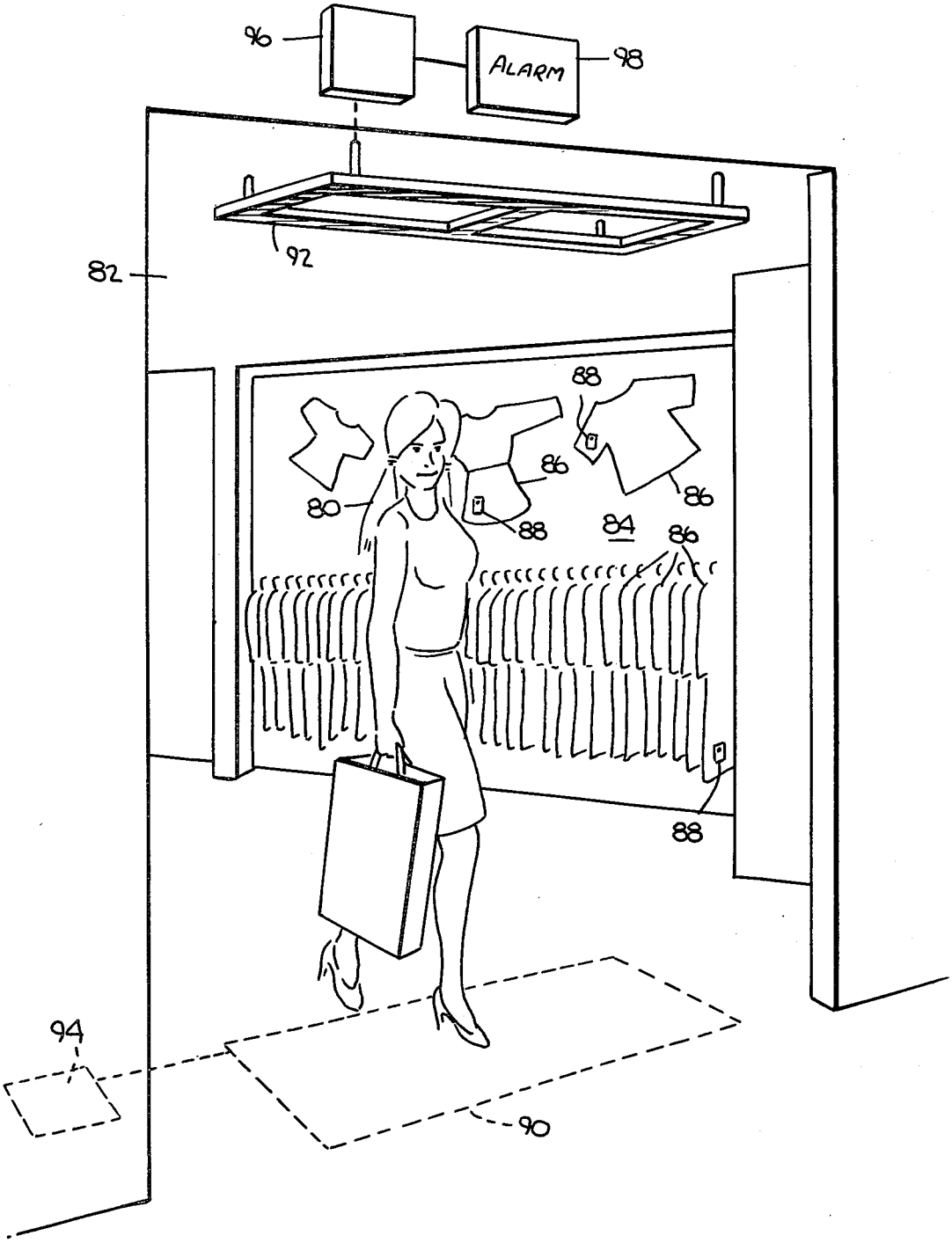
FIG. 7 is a perspective view of a second embodiment of the present invention.

As pointed out above, as of the time of filing this application the embodiment of FIGS. 1-6 had been built; and the embodiment of FIG. 7 had not yet been built but was proposed and was believed to be capable of successful operation.

DETAILED DESCRIPTION OF THE PREFERRED EMBODIMENTS

Figure 1:
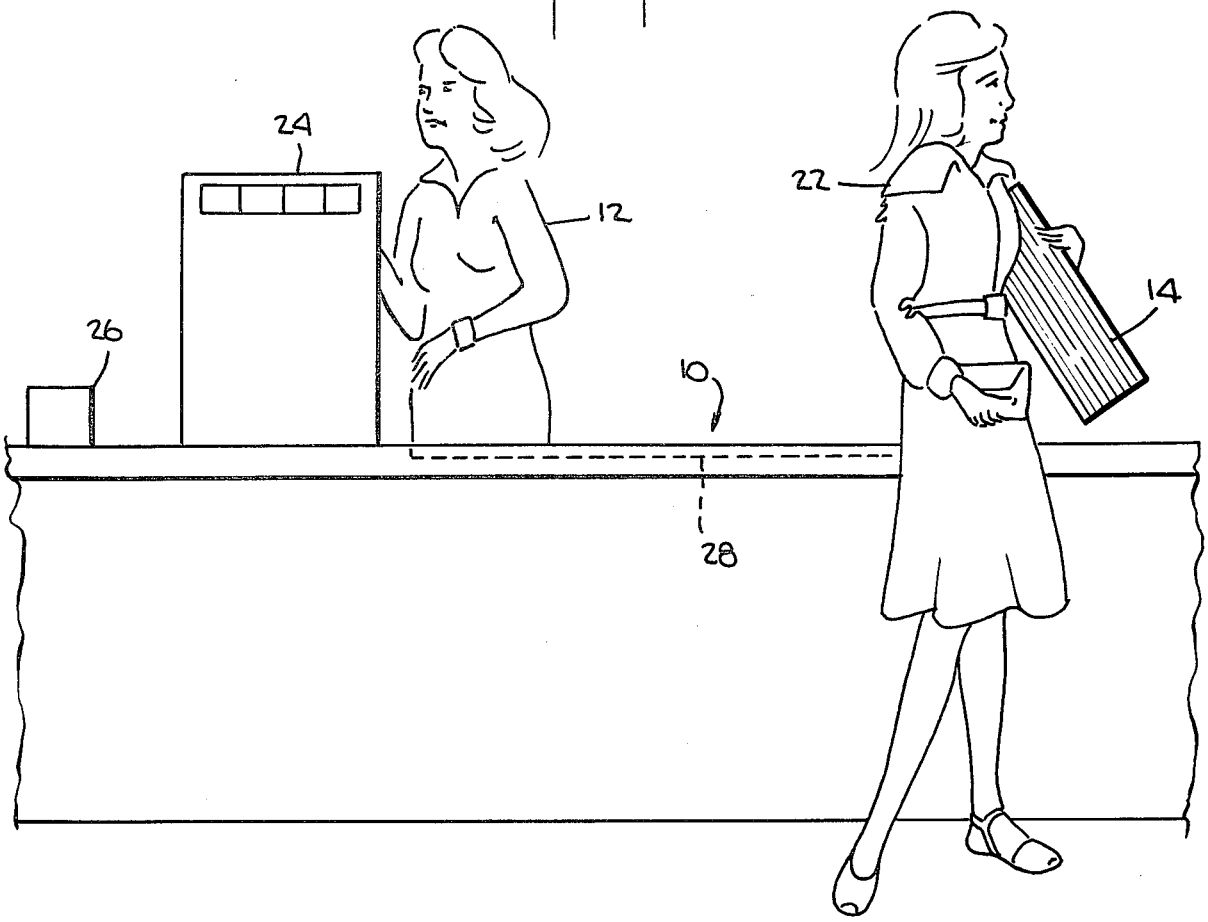
FIG. 1 is a side elevational view of a cashier's counter in which a first embodiment of the invention is used.
Figure 3:
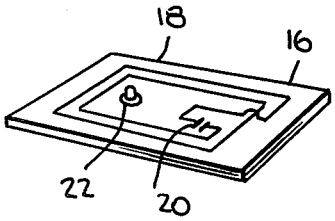
FIG. 3 is a perspective view, partially in schematic, of a target wafer used in conjuction with the embodiment of FIG. 1.
Figure 3:
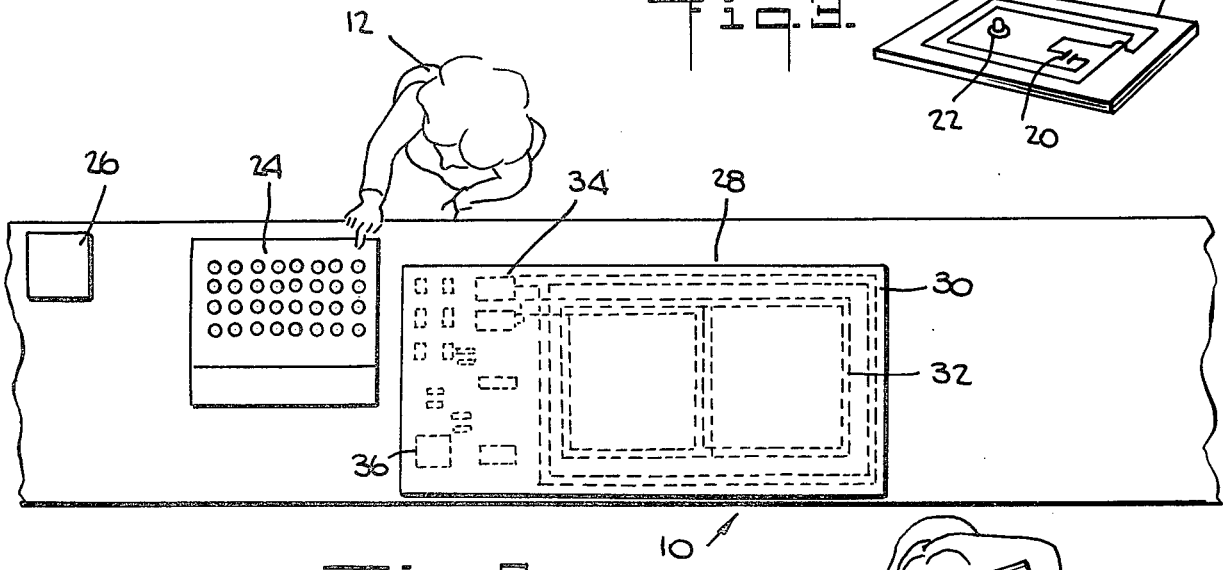

The embodiment of FIG. 1 is used in conjunction with an electronic theft detection system, for example, a system such as shown and described in U.S. Pat. No. 3,500,373. The theft detection system is used to protect articles of merchandise, such as foods in a store, from theft by shoplifting. The protected goods are provided with special targets containing resonant electrical circuits. When an article having such a wafer attached to it is carried through a doorway or other exit from a protected area, it causes a distinctive electromagnetic disturbance at the doorway or exit. This disturbance is detected and an alarm is activated. When the protected goods are bought and paid for, a clerk or cashier removes the wafer from the goods and they can then be carried through the doorway or exit without the alarm being activated.

The embodiment of FIG. 1 detects a target wafer and provides a reminder which notifies the cashier if the target wafer is not removed from the goods when they are bought and paid for. As shown in FIG. 1 there is provided a cashiers "wrap desk" or counter 10 in a store where a cashier 12 receives articles 14 being purchased. The articles 14, prior to purchase, have special wafers attached to them; and, as shown schematically in FIG. 3, the wafers, 16, each have embedded therein a resonant electrical circuit comprising a coil 18 and a capacitor 20. The wafers 16 may be attached to the articles 14 by a magnetically releaseable fastener 22 such as shown in U.S. Pat. No. 3,911,534. If an article 14 is brought out from the store or from a protected area in the store with a wafer 16 attached, the resonant circuit in the wafer will cause an electromagnetic disturbance which will be detected and which will cause an alarm to be activated. When, however, a legitimate purchase is made, a customer 22 (FIG. 1) brings the article 14 to the wrap desk 10 where the cashier 12 receives payment and enters same in a register 24. The cashier then places the wafer 16 on a special tool 26 to remove it from the article before wrapping the article or otherwise preparing it for delivery to the customer 22. The special tool 26 may be a chopper device such as shown in U.S. Pat. No. 3,748,936; or, if a magnetically releaseable fastener is used on the wafer 16, the special tool may be a powerful permanent magnet.

Figure 2:
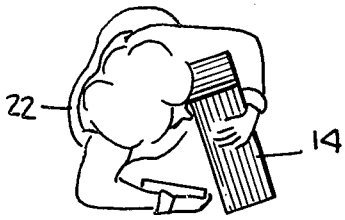
FIG. 2 is a top plan view of the embodiment of FIG. 1.

Embedded in the wrap desk 10 is detection device 28 according to the present invention. As can be seen in FIG. 2, the detection device comprises a transmitter antenna 30 in the form of a two turn rectangular loop, a receiver antenna 32 in the form of a two turn rectangular figure eight loop contained just inside the transmitter antenna and an elctronics module 34 to which the antennas 30 and 32 are connected. The electronics module 34 will be described more fully hereinafter.

When the cashier 12 has prepared the purchased article 14 for delivery to the customer 22, the cashier passes the article across the wrap desk 10 over the antennas 30 and 32. The region of the wrap desk over the antennas 30 and 32 constitutes an interrogation zone. When the transmitter antenna 30 is energized it produces electromagnetic fields in the interrogation zone which induce currents in the resonant circuit of a wafer 16 in the zone; and current flowing in the wafer circuit will generate electromagnetic disturbances or fields which in turn induce current in the receiver antenna 32. If the wafer 16 has not been removed from the article it will be detected by the detection device 28 and an alarm 36 will be activated to remind the cashier to remove the wafer.

Figure 4:
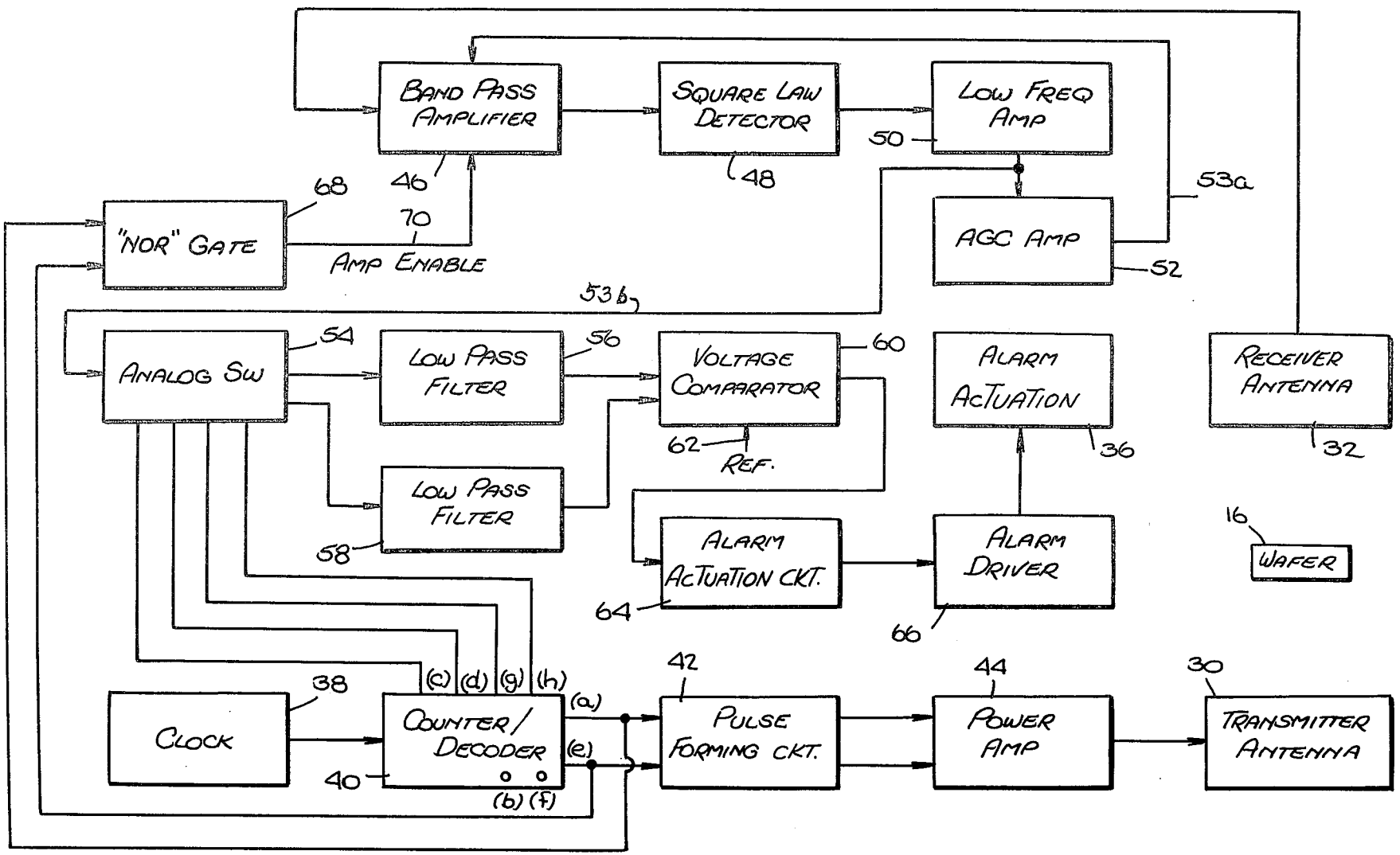
FIG. 4 is a block diagram of the embodiment of FIG. 1.

The electronics module 34 of the detection device 28 is shown in block diagram form in FIG. 4. As can be seen, there is provided a clock 38 which is connected to a counter-decoder 40. The clock 38 generates pulses at a rate of about 120 kilohertz which it supplies to the counter-decoder 40. The counter-decoder 40 divides these pulses by eight and produces output pulses in succession at eight different output terminals (a), (b), (c), (d), (e), (f), (g) and (h). Two of the output terminals (a) and (e) are connected to a pulse forming circuit 42 which produces very sharp spike pulses. These spike pulses are amplified in a power amplifer 44 and are then supplied to the transmitter antenna 30. The transmitter antenna produces a correspondingly sharp and short duration electromagnetic interrogation field; and this field induces electrical currents in the resonant circuit in the wafer 16 when the wafer is in the vicinity of the transmitter antenna. The resonant circuit thereby disturbs the electromagnetic interrogation field by radiating electromagnetic fields of its own at its resonant frequency. These radiated fields from the wafer resonant circuit cause corresponding currents to be induced in the receiver antenna 32.

The receiver antenna 32, as shown in FIG. 4, is connected to a variable gain band pass amplifier 46. Signals which pass through the amplifer 46 are detected in a square law detector 48 and are amplified in a low frequency amplifer 50. The output from the amplifier 50 is amplified in an automatic gain control amplifer 52 and is fed back, via a gain control line 53*a*, to adjust the gain of the band pass amplifier 46. Another output of the low frequency amplifier 50 is applied via a line 53*b* to an analog switch 54, and from there to first and second accumulators or low pass filters 56 and 58.

Four other output terminals (c), (d), (g) and (h) of the counter-decoder 40 are also connected to the analog switch 54. The signals on these terminals cause the switch 54 to direct signals from the low frequency amplifier 50 into the first and second accumulators or low pass filters 56 and 58 at predetermined times. These accumulators or filters accummulate electrical charges according to the signals from the low frequency amplifier 50 which are applied to them at the times determined by the signals at the terminals (c), (d), (g) and (h) of the counter-decoder 40. The other output terminals (b) and (f) of the counter-decoder 40 are not connected to any other circuit. The charges accumulated in the accumulators or filters 56 and 58 are compared in a voltage comparator 60. When the voltage charge in the first accumulator or low pass filter 56 exceeds that accumulated in the second accumulator or low pass filter 58 by a predetermined amount (corresponding to a reference input 62), an output is produced by the voltage comparator. This output is applied to a alarm actuation circuit 64 which causes the output to be extended in time. This extended output is applied to an alarm driver 66 which activates the alarm 36.

The outputs (a) and (e) from the counter-decoder 40, which are supplied to the pulse forming circuit 42, are also applied to a NOR gate 68 which in turn produces an enable signal on an enable line 70. The enable line is connected to the band pass amplifier 46 and causes the band pass amplifier to permit signals from the receiver antenna 32 to be detected in the square-law detector 48 only for a predetermined duration following the occurrence of an interrogation signal.

Figure 5:
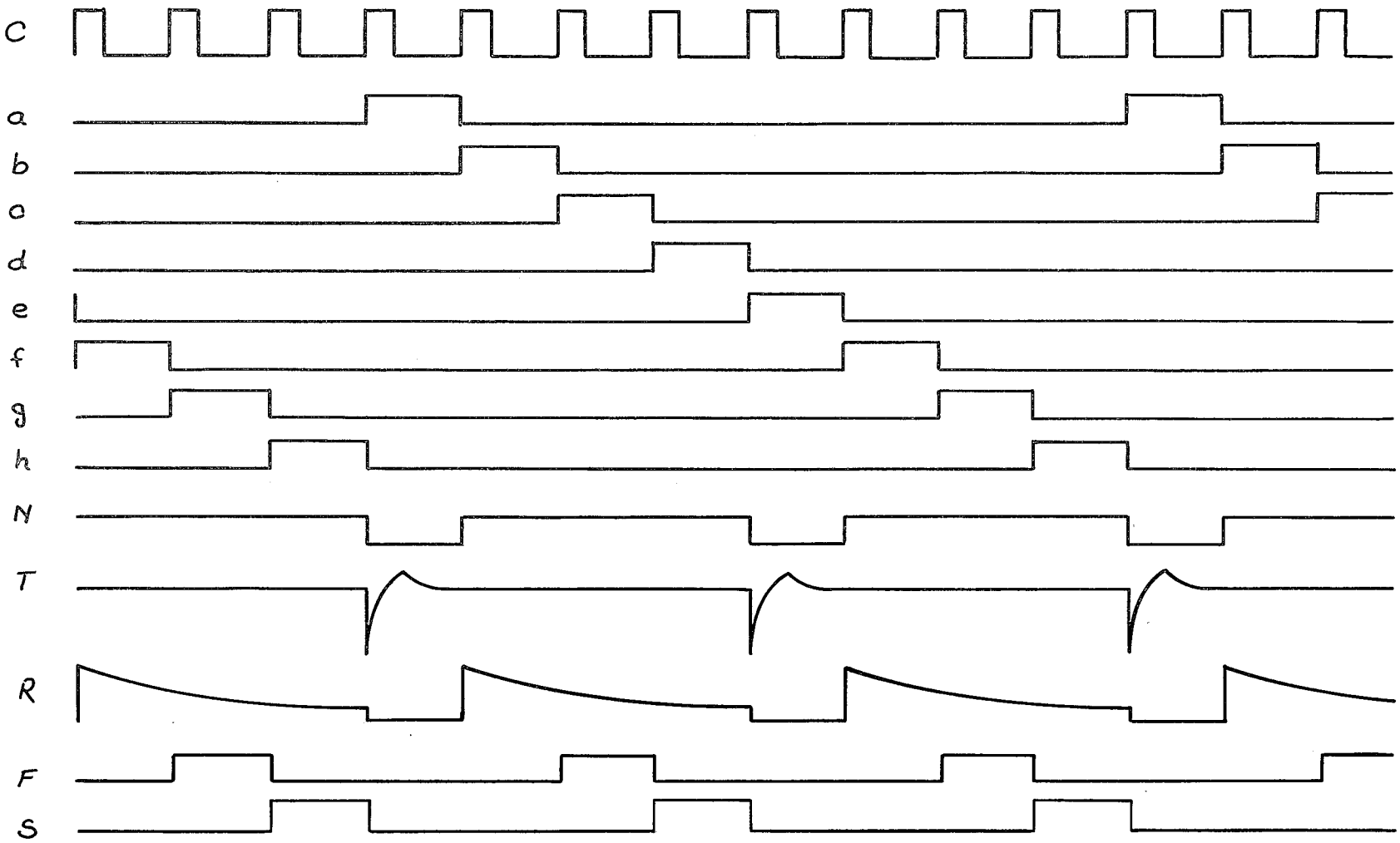
FIG. 5 is a series of waveforms showing the operation of the embodiment of FIG. 1.

The manner in which the detection device 28 operates to detect the electromagnetic disturbances produced by the wafer 16 can be seen in the timing diagram of FIG. 5. As pointed out above, the clock 38 produces pulses at a rate of about 120 KHZ. These pulses, which are shown at curve (C) in FIG. 5, are spaced by 8.3 microseconds (μsec.) and they have a width of about 3 μsec. The counter-decoder 40 produces an output at each of its different outputs (a), (b), (c), (d), (e), (f), (g) and (h) in succession for the duration between successive pulses from the clock 38. These outputs are shown by corresponding curves (a), (b), (c), (d), (e), (f), (g) and (h) of FIG. 5.

Curve N in FIG. 5 represents the voltage output of the NOR gate 68. It will be seen that this voltage becomes negative during the occurence of each pulse from the outputs (a) and (e) of the counter-decoder 40.

Curve T of FIG. 5 represents the voltage across the transmitter antenna 30. It will be seen that the transmitter antenna receives a large and very narrow negative spike voltage at the beginning of each pulse from the outputs (a) and (e) of the counter-decoder 40. These negative voltage spikes are preferably about 24 volts and they have a duration less than 1 μsec., preferably 0.3 μsec. These sharp negative voltage spikes cause the transmitter antenna 30 to generate correspondingly sharp interrogation pulses in the form of electromagnetic fields in the vicinity of the wrap desk 10. The interrogation pulses are separated by intervals corresponding to four pulses from the clock 38 or about 33 μsec. If an article 14 with a wafer 16 attached is located on the wrap desk when these interrogation pulses are being generated, the electromagnetic interrogation fields will induce alternating current flow in the resonant circuit of the wafer. This induced current flow in the wafer circuit continues after each very short duration interrogation pulse has ended; and the amplitude of the alternating current flow in the wafer circuit diminishes at a rate corresponding to the Q of the wafer circuit. The wafer current in turn produces a corresponding electromagnetic disturbance in the form of an electromagnetic field of gradually decaying amplitude in the vicinity of the wafer.

The gradually decaying electromagnetic field produced by the wafer circuit induces corresponding current flow in the receiver antenna 32. However, for the duration of the pulse (a) or (e) from the counter-decoder 40, i.e., a duration of about 8 μsec. following the interrogation pulse, the NOR gate 68 prevents the band pass amplifier 46 from passing any signals generated by the reveiver antenna 32. This isolates the receiver from the large amplitude fields generated by the transmitter antenna. As can be seen in curve T, the voltage across the transmitter antenna does not come to zero immediately after the negative voltage spike has been generated. Instead, the transmitter voltage becomes positive and thereafter gradually settles to zero. By preventing the band pass amplifier 46 from passing signals during the 8 μsec. period following the initiation of an interrogation pulse it is ensured that no transmitter generated disturbance will pass into the receiver.

Curve R of FIG. 5 represents the gradually decaying signal from the wafer 16 which passes into the receiver after the NOR gate 68 has enabled the band pass amplifier 46, i.e. after the first 8 μsec. following the initiation of the transmitter interrogation pulse. The received signal is detected in the square law detector 48 and the low frequency amplifier 50 and is then applied to the analog switch 54. It will be noted that the received signal extends over the remainder of the interval between successive interrogation pulses and it decays at an exponential rate. This is a characteristic unique to a high Q resonant circuit and it is the characteristic which is used to detect the wafer circuit signal and isolate it from electrical noise. In the present invention the rate of decay of the signal represented by curve R of FIG. 5 is detected and when it is ascertained to be at a predetermined amount, corresponding to that of a wafer circuit, an alarm is activated. The amount of this decay is ascertained by directing the received signal into different accumulators or low pass filters 56 and 58 during different time segments in each interval between successive interrogation pulses and by comparing the amplitudes of the signals in the accumulators or filters 56 and 58. When that difference reaches a predetermined amount the alarm 36 is actuated. The different time segments are established by the analog switch 54 which operates in response to signals from the counter-decoder 40 to direct signals corresponding to detected electromagnetic fields into the accumulators 56 and 58 at different time segments in each interval. Curve F represents the voltages applied to the analog switch 54 from the outputs (c) and (d) of the counter-decoder 40 and curve S represents the voltage applied to the analog switch 54 from the outputs (g) and (h) of the counter-decoder. When the outputs (c) and (g) are positive, the analog switch 54 directs the detected signal from the low frequency amplifier into the first accumulator or low pass filter 56. Also, when the outputs (d) and (h) are positive, the analog switch 54 directs the detected signal from the low frequency amplifier into the second accumulator of low pass filter 58. As has been explained, the low pass filters 56 and 58 do not receive any signal for the first 8 μsec. following the initiation of an interrogation signal because the band pass amplifier 46 is kept disabled during this time. Also neither of the accumulators or filters 56 and 58 receive any signal during the next 8 μsec., i.e. during the positive outputs (b) and (f) of the counter-decoder because those outputs are not connected to the analog switch 54. The second 8 μsec. period following initiation of each interrogation pulse is not used for producing an alarm because during this time the band pass amplifier 46 is enabled by the NOR gate 68 and must come to a stable operating condition.

It will also be seen that by virtue of the outputs (c) and (g) from the counter-decoder 40, the analog switch 54 directs the detected receiver signals into the first accumulator or low pass filter 56 during the third 8 μsec. period following the initiation of each interrogation pulse. Similarly, by virtue of the outputs (d) and (h), the detected receiver signals are directed into the second accumulator or low pass filter 58 during the fourth 8 μsec. period following the initiation of each interrogation pulse.

Thus, after each interrogation pulse there is a delay of about 16 μsec. Then received and detected signals are directed into the first accumulator or low pass filter 56 for a duration of about 8 μsec. and thereafter the received and detected signals are directed into the second accumulator or low pass filter 58, also for a duration of about 8 μsec. When a resonant circuit wafer has been energized by the interrogation pulse it will, because of its high Q, continue to resonate after the first 16 μsec. interval; but the amplitude of the field disturbance caused by its resonance will diminish at a predetermined rate, also dependent on its Q. Thus, during the third and fourth 8 μsec. durations following the interrogation pulse, the amplitude of the detected signal voltage directed into the first accumulator or low pass filter 56 is greater than the amplitude of the detected signal voltage directed into the second accumulator or low pass filter 58. The signal voltages accumulated in the accumulators or low pass filters 56 and 58 are compared in the voltage comparator 60; and, if the voltage in the first accumulator or low pass filter 56 exceeds that in the second accumulator or low pass filter 58 by the amount of a reference voltage applied to the reference terminal 62 of the comparator 60, the voltage comparator will produce an alarm actuation output.

The output from the voltage comparator 60 may last for only a very small fraction of a second. Accordingly, this output is applied to the alarm actuation circuit 64 where it is stretched for a predetermined length of time depending on how long one wishes the alarm to sound. The signal from the alarm actuation circuit 64 is then applied to the alarm driver 66 where it is amplified so that it can activate the alarm 36.

It will be appreciated from the foregoing that the present invention detects resonant circuit targets and distinguishes them from noise and from other electrical circuits based upon the Q of those targets. That is, the signals produced by the target response during successive time segments in the interval between interrogation pulses are compared and when the comparison shows a predetermined change in amplitude an alarm actuation signal is generated. The invention rejects noise because noise amplitude does not change at a predetermined rate as does the decaying signal from a resonant circuit wafer. That is, when no wafer is present but considerable electrical noise is present, the amplitude of the detected signal during the third and fourth 8 μsec. durations following an interrogation pulse will be about the same and the voltage comparator 60 will not produce an output. Moreover, the present invention will not be affected by the presence of electrical noise because the noise voltage will simply be applied equally to both the accumulator of low pass filters 56 and 58 and the detected wafer signal voltage will be superimposed on the noise voltages. The noise voltages will simply cancel in the comparator 60 but the voltage difference caused by the wafer circuit will be detected.

The present invention also distinguishes resonant circuit wafers from other electrical circuits and metal objects which do not have a high Q. Those circuits and objects may be driven to emit electromagnetic field disturbances by the interrogation pulse, but because of their low Q, they will experience a very rapid decay in current flow through them after the interrogation pulse has terminated. Thus by delaying detection for a period of about 16 μsec. following the interrogation pulse the device of the present invention will not be subject to the influence of nearby electrical circuits and other metal objects whose resonance will have terminated in that period. It has been found that the invention operates well when the Q of the resonant wafer circuit is about 120 although resonant circuits with a Q of less than 100 can also be detected.

The present invention also has very low susceptibility to the effects of wafer detuning. This is because the band pass amplifier 46 and the square law detector 48 operate to detect signals in a wide band of frequencies. The device does not detect the presence of a wafer based upon the fact that it causes electromagnetic field disturbances at a given frequency but instead it detects the presence of a wafer based upon the fact that the wafer continues to resonate and cause an electromagnetic field disturbance which continues and which decays at a predetermined rate following the interrogation pulse.

In the preferred embodiment the wafer circuits are built to have a resonant frequency of about 1980 kilohertz (KHZ) and a Q of about 120. The bandpass amplifier 46, the square law detector 48 and the low frequency amplifier 50 are arranged to detect signals in the range of 1500–2500 KHZ. If two such wafers are superimposed they will produce a resultant resonant frequency of about 1600 KHZ and a Q of about 100. This altered resonant frequency is well within the detection bandwidth of the device and the resulting Q is still high enough to maintain a distinctive decaying resonance for a sufficiently long duration following an interrogation pulse so as to be detected.

Although the wide bandwidth, i.e. 1500–2500 KHZ, of the receiver is within the broadcast bandwidth of AM radio stations, it will not be affected by transmissions from those stations. Firstly, the signals from radio stations which are distant from the receiver antenna 32 will be applied equally to the two loops of its figure eight configuration and will effectively cancel. Secondly, radio broadcast transmissions do not produce the gradually decaying signal amplitude which characterizes a resonant wafer.

The detection apparatus of the present invention also avoids possible false alarms by requiring several responses from a resonant wafer being detected. This is carried out in the accumulator or low pass filters 56 and 58. Each accumulator or filter accumulates a charge according to the amplitude of the detected signals applied to it. Although a resonant wafer will cause the first accumulator or low pass filter 56 to acquire a higher voltage than the second accumulator or low pass filter 58, the difference between the two voltages will not be greater than the reference voltage set at the reference terminal 62 of the voltage comparator 60. However, the voltage charges in the accumulator or low pass filters 56 and 58 decay quite slowly; and if, upon the next interrogation pulse, the resonant wafer is still present, additional detected voltages will be diverted into the accumulators or low pass filters 56 and 58 to increase their charge and, further, to increase the difference in their respective charges. Eventually, when about eight such increases have been caused by a corresponding number of successive interrogation pulses, the difference in accumulated charge in the two accumulators or low pass filters 56 and 58 will be sufficient to overcome the reference voltage applied to the voltage comparator 60 and the voltage comparator will produce an output.

The invention is also especially advantageous in that the operation of the detection device is not adversely affected by the presence of other nearby detection devices. This is because the amplitudes of the signals produced by swept frequency or other continuous interrogation detection devices do not vary in the manner of a decaying signal from a resonant wafer. Also, nearby pulse type interrogation devices do not adversely affect the operation of the device because each device has a slightly different clock frequency and the occurrence of interrogation pulses from one device are not in synchronism with the detection durations of another nearby device. Thus it is very unlikely that the other device will be triggered by the interrogation pulses of the first device.

FIGS. 6A and 6B constitute a complete circuit diagram showing a preferred circuit configuration for each of the components of the block diagram of FIG. 4. The circuits of FIGS. 6A and 6B have been built and tested and found to operate satisfactorily. In the circuit diagrams of FIGS. 6A and 6B dashed outlines are provided to show which components are within the various blocks of the block diagram of FIG. 4.

The values of the various resistors, capacitors and coils and the manufacturer and type of the other components shown in FIG. 6 are given in the following tables.

| Resistors - (Values are in Ohms. K represents kilohms) | | | |
|---|---|---|---|
| R1-200 | R21-100 | R41-10K | R61-750 |
| R2-200 | R22-1K | R42-20K | R62-1K |
| R3-100 | R23-1K | R43-20K | R63-10 |
| R4-12K | R24-100 | R44-5.1K | R64-750 |
| R5-12K | R25-100 | R45-10K | R65-1K |
| R6-5.6K | R26-1K | R46-10K | R66-10 |
| R7-5.6K | R27-1K | R47-10K | R67-51 |
| R8-5.6K | R28-100 | R48-5.1K | R68-5K |
| R9-5.6K | R29-9.1K | R49-5.1K | |
| R10-15K | R30-4.7K | R50-3.6K | |
| R11-15K | R31-4.7K | R51-3.6K | |
| R12-100 | R32-4.7K | R52-220K | |
| R13-12K | R33-4.7K | R53-1.5K | |
| R14-12K | R34-12K | R54-1.5K | |
| R15-6.8K | R35-240 | R55-220K | |
| R16-6.8K | R36-2K | R56-250K | |
| R17-6.8K | R37-3K | R57-10K | |
| R18-6.8K | R38-3K | R58-1K | |
| R19-240 | R39-390 | R59-1K | |
| R20-240 | R40-39K | R60-1K | |

| Capacitors (Values are in farads. PF represents picofarads. UF represents microfarads) | | |
|---|---|---|
| C1-80-380 PF | C14-0.001 UF | C27-470 PF |
| C2-0.01 UF | C15-0.001 UF | C28-15 UF |
| C3-0.01 UF | C16-0.1 UF | C29-15 UF |
| C4-5.5-40 PF | C17-0.1 UF | C30-15 UF |
| C5-47 PF | C18-0.1 UF | C31-15 UF |
| C6-0.01 UF | C19-0.1 UF | C32-22 UF |
| C7-0.01 UF | C20-2.2 UF | C33-0.001 UF |
| C8-5.5-40 PF | C21-2.2 UF | C34-100 PF |
| C9-47 PF | C22-15 UF | C35-100 PF |
| C10-0.1 UF | C23-0.01 UF | C36-1000 UF |
| C11-0.1 UF | C24-15 UF | C37-0.1 UF |
| C12-0.001 UF | C25-0.1 UF | C38-1000 UF |
| C13-0.001 UF | C26-0.01 UF | C39-0.1 UF |

| Coils |
|---|
| L1-27 microhenrys |
| L2-39 microhenrys |

| Rectifiers | |
|---|---|
| CR1-1N914 | CR6-L.E.D. |
| CR2-1N914 | CR7-1N2070 |
| CR3-1N914 | CR8-1N2070 |
| CR4-1N914 | CR9-1N2070 |
| CR5-1N914 | CR10-L.E.D. |

| Transistors and Integrated Circuits |
|---|
| Q1–Q8 Motorola MPS 5172 |
| Q9 Motorola MJE 1100 |
| Q10–Q13 Motorola MPS 5172 |
| Q14–Q15 2N2219A |
| U1-Motorola MC 1496L |
| U2-Texas Instruments TL082 |
| U3-National NE 555 |
| U4-Motorola MC 14022B |
| U5-Motorola MC 14016B |
| U6-Texas Instruments TL082 |
| U7-Texas Instruments TL082 |
| VR1-Motorola MC 7815 |
| VR2-Motorola MC 7805 |
| VR3-Motorola MC 7915 |
| VR4-Motorola MC 7905 |

The numbers on the wire connections of the solid state components represent the pin connections to those components.

As can be seen in FIG. 6A and 6B the clock 38 is formed of the solid state component U3 and associated resistors and capacitors. It generates the waveform C shown in FIG. 5 which, in the illustrated embodiment is a series of square wave pulses at a frequency of 120,000 pulses per second. The counter-decoder 40 is made up of the solid state component U4. This device receives the pulse train from the clock 38 and generates eight lower repetition rate pulse trains shown as (a)–(h) in FIG. 5. The high levels of these pulses are equal in time duration to the clock period and they occur in sequence.

The NOR gate 68 comprises a portion of the solid state component U8, the rectifier CR3 and associated resistors. This circuit receives outputs (a) and (e) from the counter-decoder 40 and generates a pulse which turns the band pass amplifier 46 off when either output (a) or (e) is at its high level.

The pulse forming network 42 comprises the capacitors C34 and C35 and resistors R61 and R64, which act as differentiating means. The time constants of these circuits are adjusted to produce a narrow pulse on their respective outputs whenever their input changes from a low to a high condition. This circuit has dual inputs and outputs. It is supplied via dual parallel buffers, consisting of the transistors Q10 and Q11, from outputs (a) and (e) of the counter-decoder 40. The outputs of the pulse forming network 42 are connected via buffers, consisting of transistors Q12 and Q13, to the power amplifier 44.

The power amplifier 44 comprises transistors Q14 and Q15 which receive dual inputs from the pulse forming circuit 42. The transistors Q14 and Q15 are operated class C and they conduct current from the power supply (CR9, C36 and C37) through the transmitter antenna 30 whenever either of its inputs from the pulse shaping network is in a high condition.

The pulse forming network 42 and the power amplifier 44 are designed, in this embodiment to cause the transmitter antenna 30 to be energized with a voltage spike of about 24 volts and a width of less than 1 μsec. and preferably about 0.3 μsec.

The receiving antenna 32, (FIG. 2) as described, monitors the magnetic field produced by the wafer resonant circuit. The receiving antenna is wound in the form of a figure eight. It responds to signals produced close to the antenna but it cancels or rejects signals received from larger distances.

The band pass amplifier 46 comprises the transistors Q1, Q2, Q3, Q4, Q5, Q6, Q7 and Q8 as well as coils L1 and L2 and associated resistors and capacitors. These elements are wired to form a stagger-tuned amplifier that provides gain for the receiver antenna signal. The band pass of this amplifier is 400 KHZ centered on the resonant frequency of the wafer circuit. The band pass amplifier receives, in addition to the signal from the antenna, an enable signal via the line 70 from the NOR gate 68. This enable signal is present and turns the amplifier on whenever the signal corresponding to the time period represented by the outputs (a) and (e) of the counter-decoder 40 are in their low condition (see curves (a) and (e) of FIG. 5). This ensures that the signal coupled directly from the transmitter antenna 30 to the receiving antenna 32 is not amplified and passed on to the detector 48.

A further signal is supplied along line 53 from the automatic gain control amplifier 52 to the junction between the resistors R4 and R5 to adjust the gain of the band pass amplifier in such a way as to maintain the average output of the square law detector 48 constant.

The square law detector 48 comprises the solid state component U1 and associated resistors and capacitors. This device is arranged as a four quadrant multiplier and it has both of its inputs connected to the output of the band pass amplifier 46. This arrangement results in the output of the detector being the square of the output of the band pass amplifier. The detector 48 also provides considerable gain for the detected signal.

The low frequency amplifier 50 comprises the solid state component U8 and associated resistors and capacitors. The amplifier provides gain and functions as a low pass filter by amplifying only the low frequency components from the square law detector 48. The output of the low frequency amplifier is transmitted as inputs to the automatic gain control amplifier 52 and to the analog switch 54. The automatic gain control amplifier 52 comprises a portion of the solid state component U2, the rectifiers CR1 and CR2 and associated resistors and capacitors. This amplifier compares the signal level at its input from the low frequency amplifier 50 with a reference level and transmits, via line 53*a*, to the band pass amplifier 46, a signal that increases the gain of the band pass amplifier if its input level is too low or decreases the gain of the bandpass amplifier if its input level is too high. This regulating action optimizes the gain of the band pass amplifier for signal conditions at its input as received from the receiving antenna.

The analog switch 54 comprises the solid state component U5 and it receives detected signal inputs via a line 53*b* from the low frequency amplifier 50. The analog switch 54 connects the signal line 53*b* from the low frequency amplifier to the first signal accumulator or low pass filter 56 during the time periods when high outputs appear on the terminals (c) and (g) of the counter-decoder 40. (see curves (c) and (g) of FIG. 5) The analog switch 54 also connects the signal line 53*b* from the low frequency amplifier 50 to the second signal accumulator or low pass filter 58 during the time periods when high outputs appear on the terminals (d) and (h) of the counter-decoder (see curves (d) and (h) of FIG. 5). This permits the accumulators or low pass filters 56 and 58 to charge to the average level of the output of the low frequency amplifier 50, present during the time each is connected by the analog switch 54 to the low frequency amplifier 50.

The voltage comparator 60 comprises the solid state component U6, a portion of the component U7 and associated resistors and capacitors. This device produces an output whenever the accumulated signal level from the accumulator or low pass filter 56 exceeds that in the accumulator or low pass filter 58 by an amount greater than a reference input applied via the resistor R52.

The alarm actuation circuit 64 comprises the remaining portion of the component U7 the rectifiers CR4 and CR5 and associated resistors and capacitors. This circuit maintains an input to the alarm driver circuit 66 for a pre-set time after its input from the voltage comparator 60 changes from its active level (with a high output) to its inactive level (with a low output). This control ensures that the alarm output will continue for at least a predetermined minimum duration even for very short duration responses from a wafer being detected.

The alarm driver 66 comprises the transistor Q9 and the rectifiers CR6 and CR7. This circuit makes electrical connection to the alarm whenever it receives an input from the duration circuit 64.

The alarm 36 is a broad band audio generator which produces a buzzing sound whenever it is energized by the alarm driver, thereby to signal that a resonant circuit wafer has passed into the interrogation zone.

Turning now to FIG. 7 the invention is shown as set up to constitute the theft detection system itself. As shown in FIG. 7, a store patron 80 exits through a doorway 82 from a protected area 84 of a store or other location where protected articles of merchandise 86 are kept. The articles 86 have resonant circuit wafers 88 fastened to them. A transmitter antenna 90 is arranged on the floor at the doorway 82 and a receiver antenna 92 is arranged overhead. The antennas may be constructed as shown and described in U.S. Pat. No. 4,135,184 and they form an interrogation zone between them. These antennas are connected to electronics modules 94 and 96 which are of the same construction as described above in connection with FIGS. 5, 6A and 6B and they operate in the same manner. When the patron 80 exits from the protected area 84 through the doorway 82 and passes through the interrogation zone defined by the antennas 90 and 92 any resonant circuit wafer which may be still attached to an article she is carrying will be detected and an alarm, such as an overhead alarm light 98 will be activated. In the embodiment of FIG. 7 it is suggested that the interrogation signals supplied to the transmitter antenna 90 be in the form of pulses having a 100 volt height and less than one microsecond duration, preferably about 0.3 microseconds. The intervals between pulses should be about the same as described above for the embodiment of FIG. 1.

We claim:

1. Apparatus for detecting, in an interrogation zone, an article of merchandise on which is fastened a wafer containing a resonant electrical circuit, said apparatus comprising:

means for generating interrogation signals in the form of short pulses of electromagnetic field energy in said interrogation zone, said pulses being separated by intervals, means for detecting electromagnetic energy in said interrogation zone during the interval following each pulse, and means for actuating an alarm in response to a predetermined amount of variation of electromagnetic energy detected during said intervals.

2. Apparatus according to claim 1 wherein said means for actuating an alarm comprises means responsive to the variation of detected electromagnetic field energy which occurs after a predetermined time following each pulse.

3. Apparatus according to claim 2 wherein said predetermined time is sufficient to permit transients in said generating and detecting means to subside following each pulse.

4. Apparatus according to claim 2 wherein said predetermined time is sufficient to permit electrical responses from objects other than resonant electrical circuits in said interrogation zone to subside following each pulse.

5. Apparatus according to claim 1 wherein said means for actuating an alarm comprises means for comparing the amplitudes of signals generated during different segments within each interval.

6. Apparatus according to claim 5 wherein said time segments occur after a predetermined time following each pulse to permit transients in said generating and detecting means and responses from objects other than resonant circuits in said interrogation zone to subside following each pulse.

7. Apparatus according to claim 1 wherein said means for actuating an alarm comprises means for directing signals corresponding to the detected electromagnetic field energy into different signal accumulators during different time segments in each interval and means for comparing the amplitudes of the signals in said accumulators.

8. Apparatus according to claim 7 wherein said means for directing signals includes a switch.

9. Apparatus according to claim 8 wherein said switch is operated by a timing clock which operates said means for generating interrogation signals.

10. Apparatus according to claim 9 wherein said timing clock and switch are arranged to provide two such time segments in each interval.

11. Apparatus according to claim 10 wherein said timing clock and switch are arranged such that said two time segments are adjacent each other.

12. Apparatus according to claim 7 wherein each signal accumulator is connected and arranged to accumulate detected signals during corresponding time segments in a plurality of intervals.

13. Apparatus according to claim 12 wherein said means for comparing the amplitudes of the signals in each accumulator is set to produce an output when the difference in the detected signals accumulated in said accumulators corresponds to the difference produced in several successive intervals by a resonant circuit within said interrogation zone.

14. Apparatus according to claim 1 wherein said means for detecting electromagnetic energy in said interrogation zone includes a gate, said gate being controlled by said means for generating interrogation signals to prevent said means for detecting electromagnetic energy from operating for a predetermined time following each pulse.

15. Apparatus according to claim 14 wherein said predetermined time is sufficient to permit electrical transients within said transmitting and detecting means to subside.

16. Apparatus according to claim 14 wherein said predetermined time is sufficient to permit electrical responses from other objects in said interrogation zone, not carrying a resonant electrical circuit, to subside.

17. Apparatus according to claim 1 wherein said means for generating an alarm comprises a pair of signal accumulators and an electrical switch arranged to receive detected signals from the detecting means, said electrical switch being connected to be switched by said means for generating electrical signals to direct said detected signals into one of said accumulators during a first time segment in each interval and into the other accumulator during a second time segment in each interval.

18. Apparatus according to claim 17 wherein said means for generating interrogation signals comprises a clock for generating a continuous series of pulses, a counter for producing said pulses sequentially on different output terminals, an interrogation pulse generator connected to one of said terminals, and said electrical switch being connected to others of said terminals.

19. Apparatus according to claim 18 wherein said means for detecting electromagnetic energy includes a gate connected to be opened in response to signals from a further terminal of said counter to prevent operation of said detecting means for a predetermined time following each interrogation pulse.

20. Apparatus according to claim 1 wherein said means for generating interrogation signals and said means for detecting electromagnetic energy comprise antenna means arranged on a counter top on which articles of merchandise are prepared for delivery to a customer.

21. Apparatus according to claim 20 wherein said antenna means comprises a transmitter antenna forming part of said means for generating interrogation signals and a receiver antenna forming part of said means for detecting electromagnetic energy.

22. Apparatus according to claim 21 wherein said receiver antenna is in the form of two loops wound in opposite directions.

23. Apparatus according to claim 1 wherein said means for generating interrogation signals and said means for detecting electromagnetic energy comprise antenna means arranged along an exit from a protected area in which articles of merchandise on which wafers containing a resonant circuit are fastened.

24. A method for detecting, in an interrogation zone, an article of merchandise on which is fastened a wafer containing a resonant electrical circuit, said method comprising the steps of:

generating interrogation signals in the form of short pulses of electromagnetic field energy in said interrogation zone, said pulses being separated by intervals, detecting electromagnetic energy is said interrogation zone during the interval following each pulse, and actuating an alarm in response to a predetermined amount of variation of electromagnetic energy detected during said intervals.

25. A method according to claim 24 wherein the step of actuating an alarm is carried out by accumulating separately signals corresponding to the detected electromagnetic field energy which occur during different time segments in each interval, comparing the amplitudes of the separately accumulated signals and actuating said alarm when a predetermined difference exists between the compared amplitudes.

26. A method according to claim 24 wherein the step of actuating an alarm is carried out in response to a predetermined amount of variation of electromagnetic energy detected after a predetermined amount of time following each pulse.

27. A method according to claim 26 wherein said predetermined amount of time is sufficient to permit electrical transients produced in the generating and detecting steps to subside.

28. A method according to claim 26 wherein said predetermined amount of time is sufficient to permit electrical responses from other objects in said interrogation zone, not carrying a resonant electrical circuit, to subside.

29. A method according to claim 24 wherein signals occuring in corresponding time segments in a plurality of intervals are accumulated and compared.

30. A method according to claim 24 wherein signals occuring in two time segments in each interval are compared.

31. A method according to claim 30 wherein said two time segments are adjacent each other.

* * * * *